US010925333B1

(12) United States Patent
McKenzie

(10) Patent No.: US 10,925,333 B1
(45) Date of Patent: Feb. 23, 2021

(54) FACE MASK WITH AN ADJUSTABLE HEADBAND

(71) Applicant: Tess Maria McKenzie, Mokena, IL (US)

(72) Inventor: Tess Maria McKenzie, Mokena, IL (US)

( * ) Notice: Subject to any disclaimer, the term of this patent is extended or adjusted under 35 U.S.C. 154(b) by 0 days.

(21) Appl. No.: 17/016,828

(22) Filed: Sep. 10, 2020

Related U.S. Application Data

(60) Provisional application No. 63/032,109, filed on May 29, 2020.

(51) Int. Cl.

| | |
|---|---|
| ***A61F 11/00*** | (2006.01) |
| ***A41D 13/11*** | (2006.01) |
| *A42B 1/004* | (2021.01) |
| *A42B 1/241* | (2021.01) |

(52) U.S. Cl.
CPC ..... *A41D 13/1161* (2013.01); *A41D 13/1107* (2013.01); *A42B 1/004* (2013.01); *A42B 1/241* (2013.01)

(58) Field of Classification Search
CPC ..... A41D 13/1161; A41D 13/1107; A41D 13/11; A41D 13/1176; A41D 13/1192; A41D 13/1153; A41D 13/1169; A41D 13/1184; A41D 13/1115; A41D 13/113; A41D 13/1138; A41D 13/1146; A42B 1/004; A42B 1/241; A42B 7/00; A62B 18/025; A61K 8/0212
USPC ..... 128/857, 863; 2/173, 410, 424, 9, 171.8, 2/DIG. 11
See application file for complete search history.

*Primary Examiner* — Victoria J Hicks
(74) *Attorney, Agent, or Firm* — Fraline J. Allgaier

(57) ABSTRACT

An improved face mask for covering the nose, mouth, and areas of the face of a user including an adjustable headband being constructed of a flexible material and being attached to the opposing side walls of the face mask. The headband is formed of flexible fabric material and includes front and back instructional surfaces for displaying instructional materials, interior and exterior pockets for storing items, a top portion having a longitudinally extending internal channel, first, second, and third bungee cord openings for adjusting the tension and length of the bungee cord strap, and a plurality of elongated through holes for inserting elongated items.

12 Claims, 8 Drawing Sheets

FACE MASK WITH AN ADJUSTABLE HEADBAND

RELATED APPLICATIONS

This application claims priority of U.S. Provisional Patent Application Ser. No. 63/032,109 filed May 29, 2020, now pending.

FIELD OF THE INVENTION

The present invention refers to an improved face mask comprising a barrier for viral and pathogenic materials and which in its preferred embodiment operates as a covering for the nose, mouth, and areas of the face. The face mask is removably attached to an adjustable headband being constructed of a flexible material and being removably attached at its side walls.

BACKGROUND OF THE INVENTION

A large number of face masks are currently on the market. The use of face masks has become an imperative in the health sector, schools, the industrial world, public transportation, and the food industry. The most important purpose of the application is to help individuals wear a face mask with the security of a novel headband and thereby protecting them from inhaling viral and pathogenic material. The face mask further aids in the emission of so-called pfluge droplets during speech, sneezing, or coughing. In general, wearing a face mask can help stop the spreading of diseases or from unknowingly spreading it to others. This can be done with other preventative actions such as those prescribed by government Organizations such as the Center for Disease Control (CDC). A well-recognized problem with face mask that are designed for children is that their faces are smaller than adults. It is often uncomfortable for children to have a single band around their ears. The state of Illinois and other locations around the world are making it mandatory for children age 2 and up to wear a face mask in school and public places. Most of the face masks that are produced are uncomfortable and children often pull them off. This puts them at risk for viruses.

This invention is particularly useful in environments where children are in close proximity to one another. The invention as prescribed herein will assist young children to retain the face mask over their nose and mouth over long periods of time. This face mask serves as a comfortable solution for children, adults, and animals in a plurality of environments where the spreading of a virus or disease is of paramount concern. For example, in such environments, the young child can quickly put on the face mask, adjust it as prescribed herein, or remove it as desired. To prevent loss or theft, the device is constructed in a manner wherein it can fit comfortably around the neck and chest when not being worn. In accordance with additional CDC requirements, the face mask is washable and can be reused as needed. In the case of a growing young child, the invention as prescribed herein provides for an expandable bungee cord strap and thereby providing for any increase in the size of the head.

Preschool children who are in a classroom and interact with more than one student can wear this adjustable headband as provided herein. It protects them from another person's viral droplets or from possibly spreading their own. It also prohibits a student from touching his nose or mouth during interactions with others. This face mask can be worn by anyone who interacts or works in close proximity to another person. It can be worn comfortably around the neck during mealtime, drink breaks for preschool children, or children who are out and about with parent or caretakers.

To this end, the invention relates to an adjustable headband that is attached to a conventional face mask. The face mask provides a barrier against the transmission of viral and pathogenic material to and from the mouth and nose of a user. The novel and distinctive features of the invention consist of a plurality of face mask support elements that are provided on the exterior or interior of the surface of the headband. The face mask is further characterized with the following novel features: (1) A face mask being attached to an adjustable headband with firm, flexible, and strong characteristics to provide support for the face mask; (2) A non-restrictive face mask that is non-occluding to the airway and prevents the inhalation of viral and pathogenic materials; and (3) A face mask with a detachable headband that can be worn along the back side of the head or on the neck.

The invention will be described with reference to an improved face mask comprising an adjustable headband being constructed of a flexible material and being removably attached thereon. Among other features, the headband is formed of flexible fabric material and features front and back instructional surfaces, an interior space for storing items, a top portion having a longitudinally extending internal channel for receiving a bungee cord strap, a plurality of bungee cord adjustment mechanisms for adjusting the headband, and a plurality of internal and external storage compartments.

Face masks comprising a barrier, which in their preferred embodiment operate as a covering for the nose, mouth and areas portions of the face are well known in the art. In a plurality of cases, the face mask is attached to a user's face with adhesives, strings, straps, adjustable fasteners, etc. Often times, the face mask is held in place by a retaining element that is moved across the back of the head.

It is well know in the art to provide a face mask that is secured to bungee cords, shock cords, or stretch cords that are presented as unattached elements. Most often, they are attached to the sides of face masks and are used to prevent the accumulation of the same under the chin of the user.

It is also well known in the art to provide a face mask having a strap that is provided within an enclosed mechanism. Patent publication number CN108244725A provides for a protective mask that includes a mask body, frame, telescopic band, respirator belt, and Velcro. In it's final adjustment phase, the respirator is fixed in place with an adjustable telescopic band. The tunnel strap feature is further provided in U.S. Ser. No. 10/456,546B2. In this case, the strap configuration features non-stretch strap segments that are connected to a flexible shuttle or a low force elastic member. A curved tunnel generally surrounds the flexible shuttles and elastic members with a smooth inner surface made of a soft, non-stretch (at least in circumference/length) material.

The tunnel strap feature can be seen in items such as clothing and bags. For example, U.S. Pat. No. 9,943,162B1 provides for a camp and rescue bag that in one mode can be used as a multi-modal rapid response rescue device. The tunnel strap includes a top circumferential band with a circumferential passage that houses a cord, which exits through a plurality of eye openings. A cord stopper is used to frictionally engage the cord to prevent the cord from sliding therethrough when the cord stopper is engaged with cord.

The general feature of providing a pocket element on a face mask is also well known in the art. Patent number FR2853497A1 provides for an active face mask that includes a pocket for protection against the transmission of viral or pathogenic elements to and from the user's airways. Unlike the pockets as provided in the present invention, the pocket is provided as a face mask support, which receives an antiseptic substrate near the nose and mouth of a user and further blocking the entry of droplets. The pockets of the present invention are provided on at least one opposing sides of the headband and are provided with an opening and closure mechanism being disposed on the front instructional surface of the headband. The external pocket of the headband as provided herein opens sideward and is provided in a manner that the face of a user is not obstructed.

It is believed, however, that none of the above methods of making a face mask describe the present invention as prescribed herein. Developing a headband having firm, flexible, and strong characteristics to provide support for a face mask and to provide additional instructional and utilitarian benefits for a user is therefore an unmet need in the art. In addition, the face mask is a non-restrictive face mask that is non occluding to the airway, comfortable to wear, and further prevents the inhalation of viral or pathogenic materials. The headband is detachable and can be worn along the back side of the head or on the neck.

BRIEF SUMMARY OF THE INVENTION

It is an advantage of the present invention to provide an improved face mask comprising a barrier to viral or pathogenic materials and which in its preferred embodiment operates as a covering for the nose, mouth, and areas of the face.

It is an additional advantage of the present invention to provide an adjustable headband being constructed of a flexible material and being attached to the side walls of a face mask.

It is an additional advantage of the present invention to provide a headband being formed of flexible fabric material and having front and back instructional surfaces for providing instruction, displaying instructional materials, or for decorating as desired by the user.

It is an additional advantage of the present invention to provide a face mask with an attached head band including interior spaces for storing items comprising at least one internal pocket and at least one external pocket. Each of the interior spaces are provided with entry points including opening and closure mechanisms and the interior spaces being used to retain items.

It is still an additional advantage of the present invention to provide a face mask with an attached head band with a top portion having a longitudinally extending internal channel with first, second, and third bungee cord openings and adjustment mechanisms for adjusting both the tension and length of a bungee cord strap.

It is still an additional advantage of the present invention to provide a face mask with an attached head band having a plurality of elongated through holes for inserting elongated items.

It is still an additional advantage of the present invention to provide a face mask with a head band that is detachable from its side walls.

It is still an additional advantage of the present invention to provide a face mask with an attached head band wherein the front and back instructional surfaces are adapted to receive stickers, allow for the placement of decorative elements, are adapted to be writeable surfaces, and are adapted to be erasable surfaces.

It is still an additional advantage of the present invention to provide a face mask with an attached head band wherein the front and back instructional surfaces are adapted to be washed and reused.

It is still an additional advantage of the present invention to provide a face mask with an attached head band wherein the front and back instructional surfaces are produced in various colors and sizes.

It is still an additional advantage of the present invention to provide a face mask with an attached head band wherein the front and back instructional surfaces are adapted to be visible at nighttime or in a dark place.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

Additional advantages and features of the present invention will become more apparent when considered in light of the following specification and drawings.

BRIEF DESCRIPTION OF THE SEVERAL VIEWS OF THE DRAWINGS

The present embodiments are illustrated by way of the figures of the accompanying drawings, which may not necessarily be to scale, in which like references indicate similar elements, and in which.

DETAILED DESCRIPTION OF THE INVENTION

Figure 1:
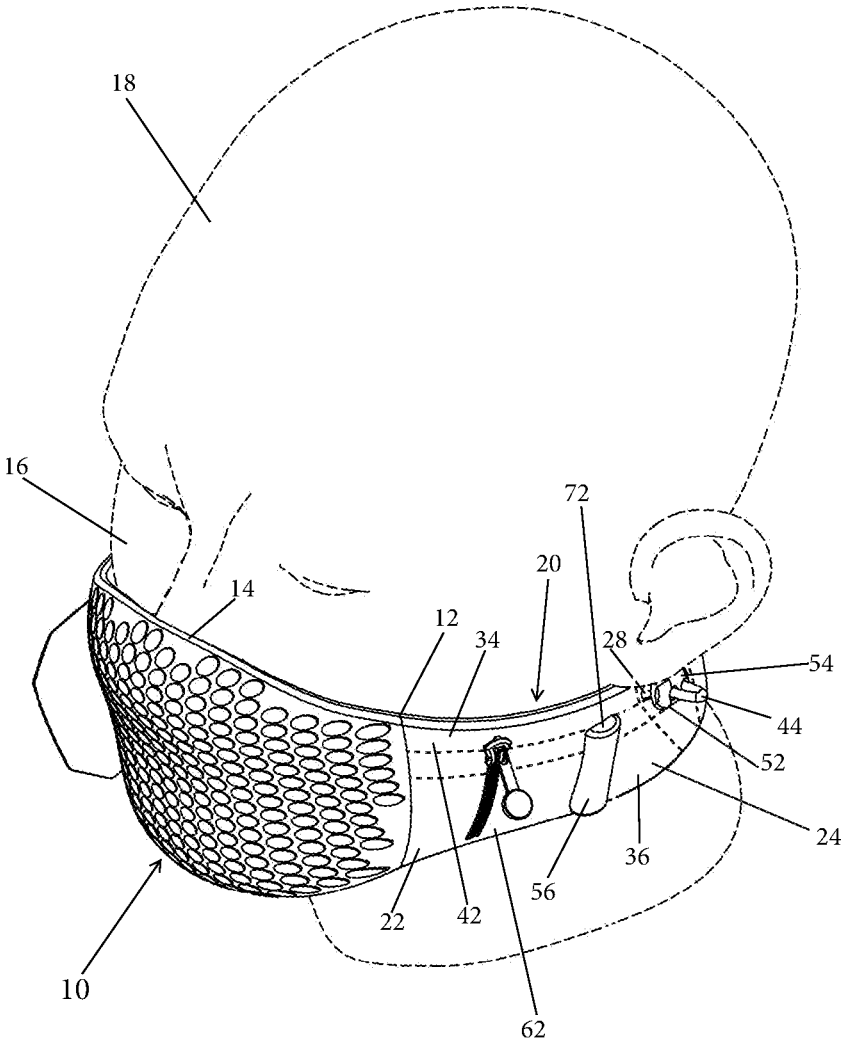
FIGS. 1 and 2 illustrate an exemplary view of the face mask with an adjustable head band in accordance with the preferred embodiments of the present invention.
Figure 2:
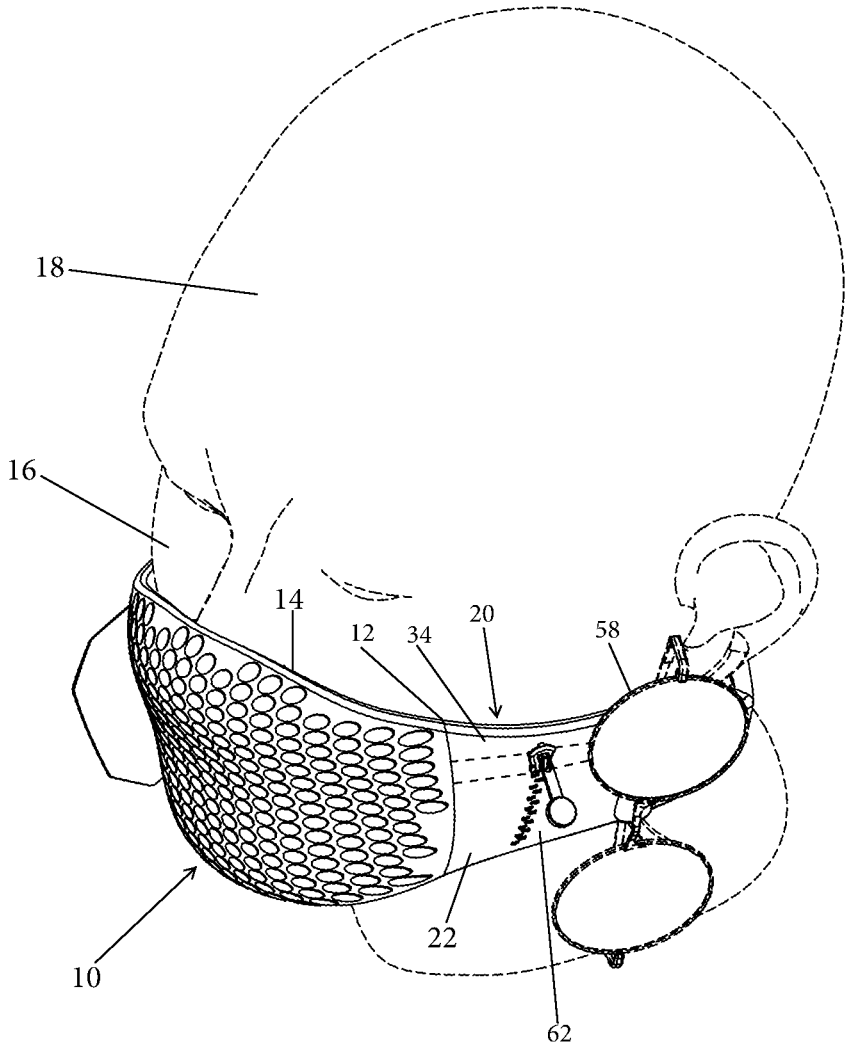
Figure 3:
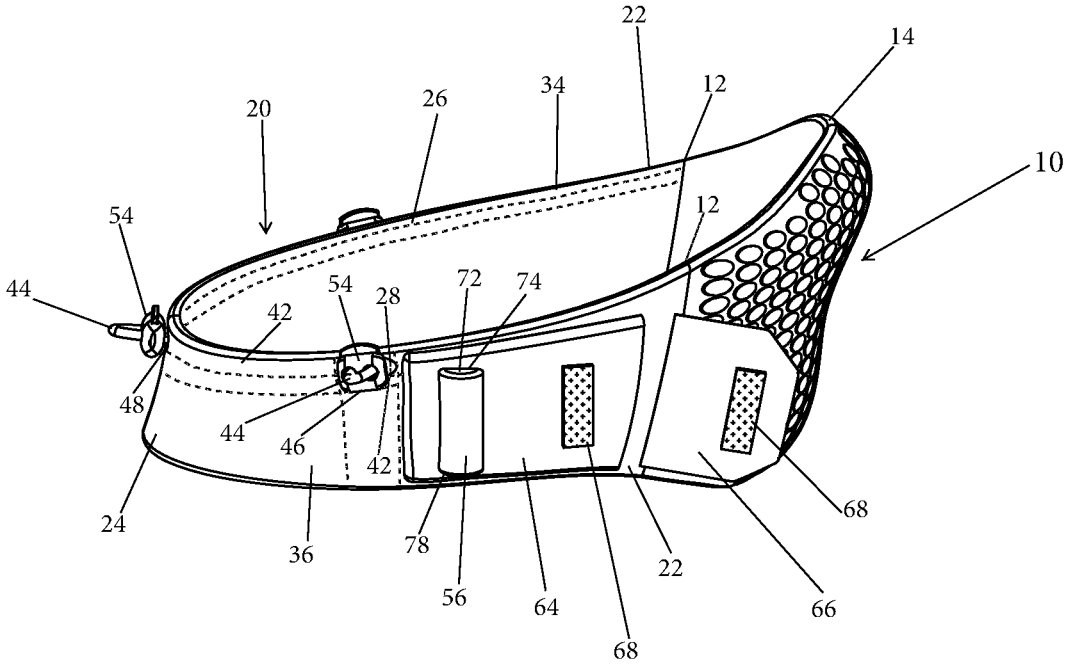
FIG. 3 illustrates a side view of the face mask with the removably attached head band, external pocket, and through hole.
Figure 4:
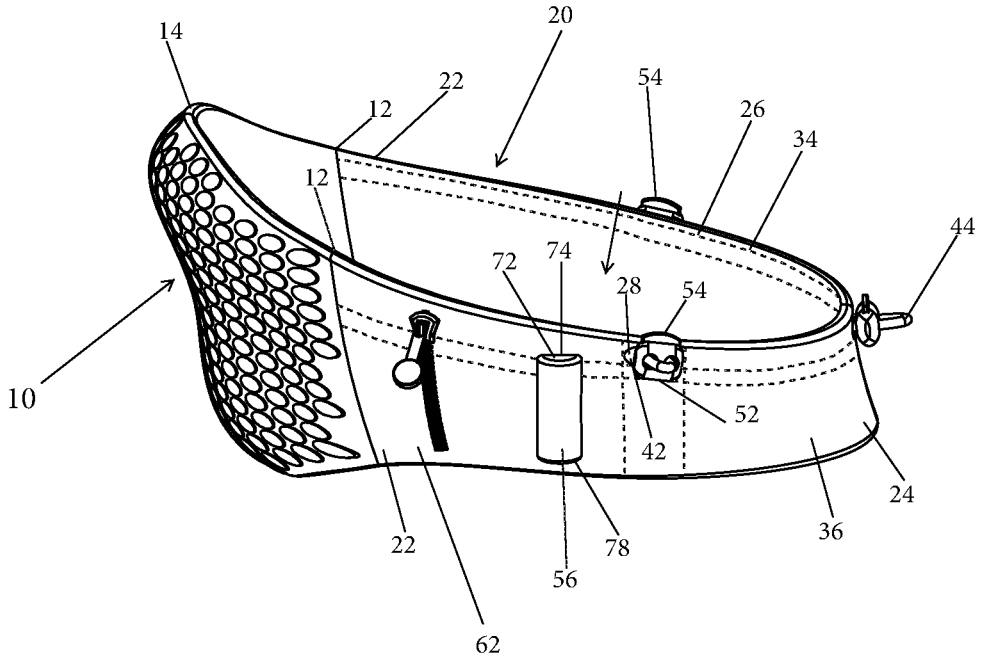
FIG. 4 illustrates a side view of the face mask with the removably attached head band, internal pocket, and through hole.
Figure 5:
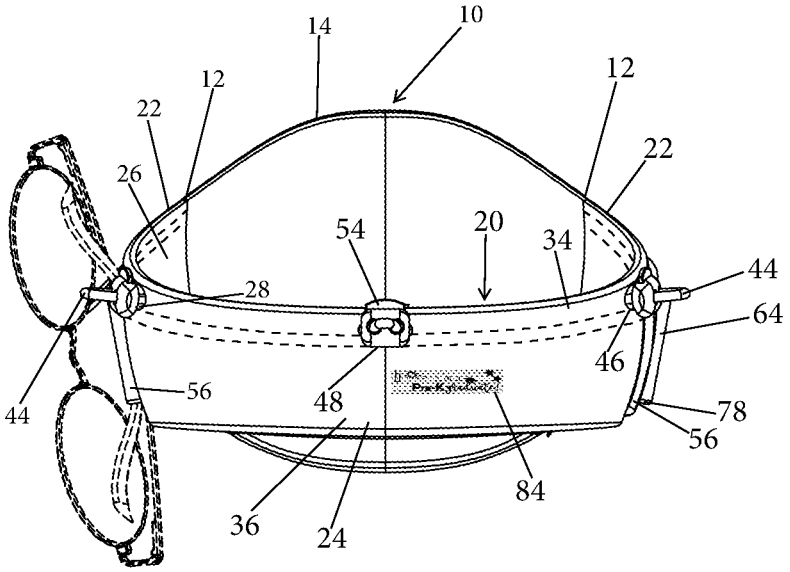
FIG. 5 illustrates a back view of the face mask with glasses being attached to the removably attached head band and decorative elements being placed thereon.
Figure 6:
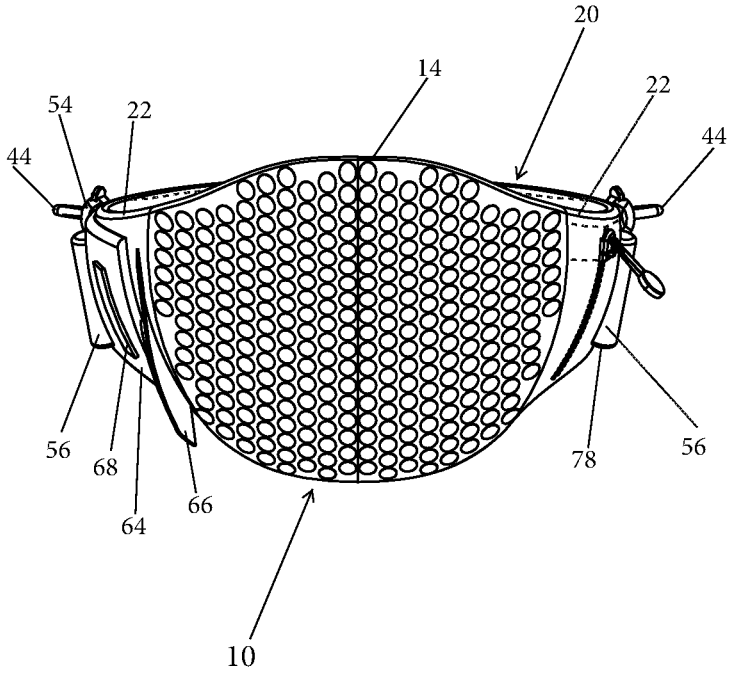
FIG. 6 illustrates a perspective view of the face mask with an attached head band in accordance with the preferred embodiments of the present invention.
Figure 7:
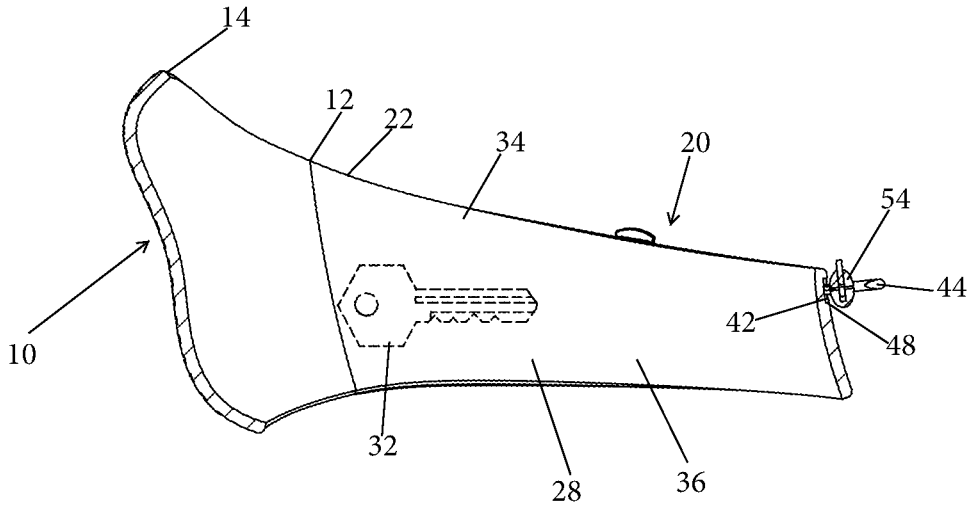
FIG. 7 illustrates a cross sectional view of the face mask and head band.
Figure 8:
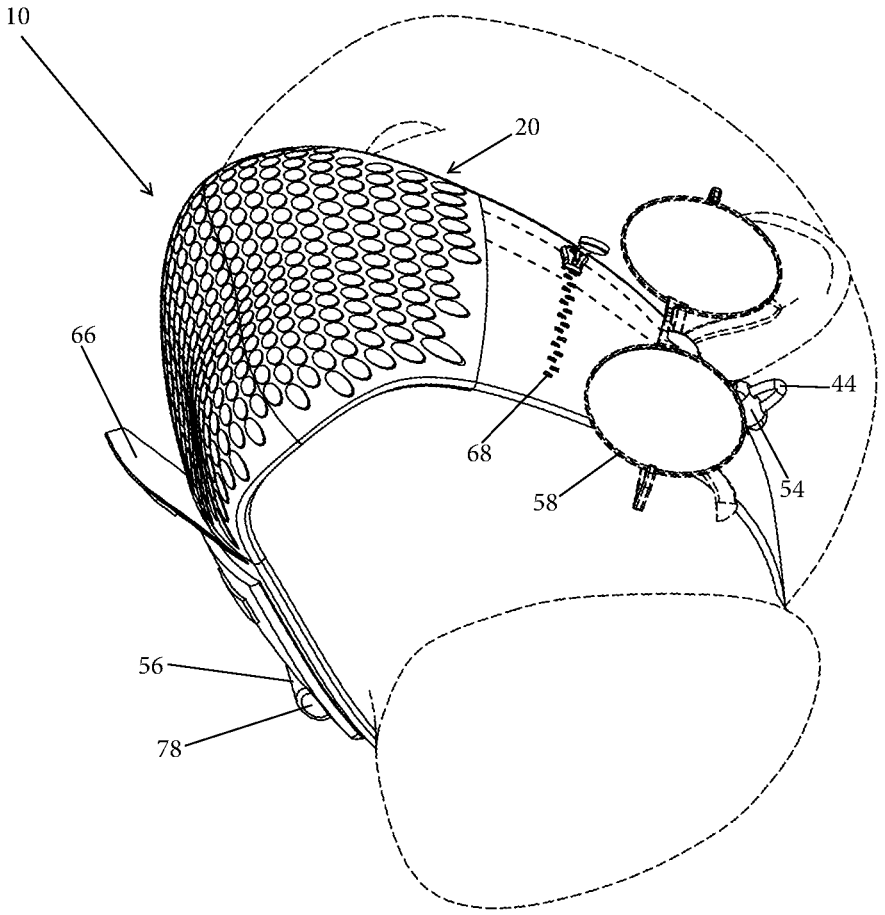
FIG. 8 illustrates a bottom view of the face mask with glasses being attached thereon.

An improved face mask 10 is disclosed. FIGS. 1-8 illustrate an exemplary type of face mask 10 whereby the face mask 10 can be securely worn as prescribed using the general government requirements by first placing the face mask 10 over the nose and mouth, securing the face mask 10 under the chin, fitting the face mask 10 snugly against the sides of the face, and further ensuring that you're able to breathe easily.

The invention as prescribed herein features an improved face mask 10 having opposing side walls 12, top rims 14, and extending along the sides of a user's face 16. The opposing side walls 12 being maintained at the same level when the face mask 10 is being worn. The face mask 10 is removably attached at its opposing side walls 12 to an adjustable headband 20 being constructed of a flexible material. The headband 20 having a body being formed of flexible fabric material and having opposing sides 22, a front instructional surface 24, a back instructional surface 26, an interior space 28, a top portion 34, a bottom portion 36, and being constructed by the vertical sealing of said fabric material at said top portion 34 and said bottom portion 36 and whereby said top portion 34 and said bottom portion 36 are closed.

The top 34 portion of the headband 20 having a longitudinally extending internal channel 42 for receiving a cord strap 44 and wherein said internal channel 42 having a first 46, second 48, and third 52 bungee cord opening and a plurality of elongated through holes 56 for inserting elongated items 58, at least one internal pocket 62, and at least one external pocket 64.

The internal pocket 62 including an opening an closure mechanism 68 and provide storage for items 32 that might require a more secure storage condition such as hearing aids, medicine, credit cards, money, and jewelry. The opening and closure mechanism 68 can be provided as a zipper, Velcro, or snap buttons. In an alternative embodiment, the internal pocket 62 can be provided with an open slit or groove for inserting the items 32.

The external pocket 64 having a flap 66 with an opening and closure mechanism 68 being provided thereon. The external pocket 64 is configured away from the back portion of the headband 20 and towards one of its opposing sides 22. Similarly, the closure mechanism can be provided as a zipper, Velcro, snap button and said external pocket 64 being provided as a storage compartment for keys, identification cards, switch cards, tickets, jewelry or other items that might require temporary storage.

The bungee cord strap 44 is inserted into said interior channel 42 and partially extends through each of the bungee cord openings 46, 48, and 52 of the internal channel 42. The bungee cord strap 44 is adjustable through the bungee cord openings 46, 48, and 52 and is connected to opposing sides 22 of the headband 20.

The bungee cord strap 44 is commonly available in a variety of diameters including ranges from ⅛ inch with a tensile strength of 100 pounds to ½ inch with a tensile strength 450 pounds. The bungee cord strap 44 can be produced in a variety of colors and additional strap material can include wide band elastic, elastic cords, or elastic retracting cords. The width of the elastic band can range from 1-2½ inches.

The head band 20 is detachable from the opposing side walls 12 and can be attached to the opposing side walls 12 of the face mask 10 by zippers, buttons, Velcro, sewing, or snap buttons. The headband 20 can be constructed to match the measurement of the face mask 10 or smaller.

The instructional materials that can be provided for use on the front instructional surface 24 and the back instructional surface 26 of the headband 20 can include stickers 84 for instructional use, instructional elements including sticky notes, pins, personal drawings, or decorative charms. The surface of the headband 20 can be made of materials that allow for the placement of said instructional materials and secure placement of the same to the front instructional surface 24 and back instructional surface 26. For example, children can decorate the headband 20 with pre-printed designs, paint, colored pencils, crayons, or markers.

The plurality of elongated through holes 56 include an inner tube 72 that extends substantially the width of the headband 20 and include a top opening 74 and a bottom opening 78 and wherein each of the elongated through holes 56 transverses the front instructional surface 24 of the headband 20. The elongated through holes 56 are permanently affixed to the headband 20.

The through holes 56 can be constructed from a durable material and are designed to receive a variety of elongated items 58 of various sizes and formats. The housing has a hollow construction and can be constructed in any size or dimension as desired by a manufacturing company or as needed by a specific group of users. Accordingly, each through hole 56 can be used to hold elongated items 58 such as handles for eyeglasses, pens, jewelry, wristwatches, pocket watches, identification badges, etc. In the case of eyeglasses, the flexible handle is positioned therein and is partially covered and folded alongside the front instructional surface 24 of the headband 20.

In use, the headband 20 is adapted to adjustably fit a range of head sizes by telescopically engaging the protruding ends of the bungee cord strap 44 from each opening 46, 48, and 52. The bungee cord is adjusted while extending parallel to the top portion 34 of the headband 20 and whereby the entire headband 20 can be positioned along the back portion of the user's head 18 or lowered towards the neck. The interior of the headband 20 further retaining any of the items 32 placed in the interior 62 or exterior pockets 64. The bungee cord strap 44 is slowly released from the adjustment mechanism 54 in order to remove the headband 20 and release the tension from around the head or neck.

The face mask 10 can be provided in a standard construction including the provision of a breathable material, horizontal and downwardly placed pleats, slits for the insertion of insert coffee filters or additional protective barriers, a standard 6×6 inch construction, ½ inch pleats on the left and right side near ears, and securely covering the nose and mouth. The face mask 10 can be produced in a standard shape or provided as desired by a user. This can include shapes that are particularly interesting for children including hearts, sun, planets, or round, square, or rectangular shapes.

The face mask 10 as prescribed herein features a wider headband 20 for placement on the neck or head 18. It can be sewn to fit the head or facial needs of a particular user. For example, in cases where a user has difficulty placing the face mask 10 over the back of the head 18, the headband 20 can be constructed as provided herein and to extend comfortably across lower or higher portions of the user's head 18.

The headband 20 could be held in place through the contraction of the elastic material. This allows for a broad range of positions to accommodate a wide range of users. With the headband 20 positioned across the user's head, the head band 20 is frictionally secured without causing undue pressure or discomfort. Maintaining the opposing side walls 12 at the same level would facilitate a quicker adjustment of the bungee cord strap 44 at each of the bungee cord openings 46, 48, and 52.

The bungee cord strap 44 is secured to a bungee cord adjustment mechanism 54 that allows for the bungee cord openings 46, 48, and 52 to securely engage with each other along the continuous length of the bungee cord strap 44. This would provide a substantially uniform adjustment through each bungee cord adjustment mechanism 54. The adjustment mechanism 54 can be a press cord of standard construction. The press buttons can be strategically placed to facilitate the adjustment of the same for left-handed or right-handed users. Further strategic placements of the bungee cord adjustment mechanism 54 can include accommodations for head coverings as desired by the user. In order to further accommodate the needs of young children and in order to address safety, the adjustment mechanism 54 can be placed toward the back of the head or neck area. This would prevent the young child from playing with the cord and further prevent a virus or disease from spreading. For older children, the adjustment mechanisms 54 can be placed on both sides of the temple. In most instances for toddlers and babies, this device as prescribed herein is not recommended for naptime. Day care centers and other childcare facilities would adhere to specific childcare regulations including the requirements of having beds 6 feet apart during rest time.

The bungee cord strap 44 can be stored within a second layer of material to conceal its straps with the bungee cord adjustment mechanism 54 located on the back of the head or neck. The bungee cord adjustment mechanism 54 can be produced in a variety of colors such as all shades of black, all shades of brown, all shades of grey, white, and all shades of primary colors. The bungee cord strap 44 and the bungee cord adjustment mechanism 54 can be produced using the identical color scheme. For example the bungee cord can be white and the press button can be white or mixed color combination. The bungee cord adjustment mechanism 54 can be produced using a plurality of durable materials including metal or plastic.

The internal pocket 62 is provided on at least one of the opposing sides 22 of the headband 20, which features at least one opening and closure mechanism 68. It is disposed on the interior space 28 of the headband 20 and wherein the internal pocket 62 is permanently affixed to the surface of the headband 20. Unlike the internally placed pocket 62, the external pocket 64 opens sideward adjacent the headband 20 so that the face of a user remains unobstructed.

An essential benefit of the present invention is that it is both inexpensive to produce and simple to both put on and remove. In a preferred construction, the attached face mask 10 is made of 100% cotton or any breathable materials that protect a person from inhaling another's droplets by nose or mouth. It can be constructed from the identical material as the face mask 10.

The fabric being used to construct the headband 20 can also be light weight, low porous count, soft, non-irritating, non-woven fabric, or fabric that mimics the construction of a standard face mask 10. The headband 20 can also be fabricated from cotton, cold weather fabric, stretchable fabric, fabric that is used to construct sporting gear or fabric that is worn when participating in outdoor activities such as football, soccer, tennis, and similar activities where an increase in exertion and movement are required. The headband 20 and the provided component parts including the pockets and through holes 56 can be constructed from additional fabric material selected from a plurality of textile including, satin, yarn varieties, durable plastic material, linen, elastic, nylon, polyester, fibers, long stringy fibrous material, or hemp mixtures. Any of the aforementioned headband arrangements can be produced in a variety of colors and covered with a plurality of fabrics including satin cloth, cotton, polyester, leather, faux, solid, printed, or plaid materials.

The headband 20 can also be constructed in a plurality of colors, textured patterns, embroidery, materials, shapes, textures, prints, and designs to reflect the personal tastes and desires of the manufacturer or users. Insignia that are useful in a particular workplace where color is required for health or safety reasons can also be used. In addition, infinite numbers of additional elements such as logos, trademarks, family reunion decorations, sports memorabilia, and reflective materials can be applied and the fabric can be intermixed between various decorative patterns, knitting, and shape designs of materials typically used to construct the same.

The front 24 and back instructional surfaces 26 of the headband 20 can be personalized with symbols, personal or business names, logos, photographs, and precious metals that are commonly used to produce jewelry such as durable metals, coral, stones, or other materials such as shells. The precious metals can include rhinestones, silver and copper mixtures, nickel, gold or gold alloys, titanium, platinum, zinc, steel, costume metals, hypoallergenic metals, and stainless steel.

Additional instructional materials 38 on the front instructional surface 24 or back instructional surface 26 of the headband 20 can include identifying medical alert information, logos for specific medical conditions, symbols, or words that represents a specific type of allergy. This possibility of providing an instructional surface can be helpful for senior citizens with dementia, Alzheimer, or any medical condition.

In the interest of personal privacy, the front instructional surface 24 of the headband 20 can be used to identify if a person is an organ donor, the exact location of a child's classroom, or numbering systems for classrooms. In the event that a child or a face mask 10 is lost, local or school authorities can make an immediate identification of the child or the face mask 10.

This invention will be massed produced locally and can be readily available for use worldwide. Accordingly, an object of the present invention is to provide a relatively light weight face mask 10 that is affordable, reliable, easily manufactured, and relatively inexpensive. The face mask 10 can be made available for schools, churches, not-for-profit institutions, and in least-developed countries where the invention as prescribed herein is not easily manufactured or made commercially available.

The Manners in which the Face Mask is Adjusted Before, During, or after Use

The face mask 10 is adjusted to fit the head of each individual person based on average head sizes. See sizes below:

| Sizes | Small | Medium | Large |
|---|---|---|---|
| Circumference | 15"-19" | 18"-20" | 20"-26" |
| Average Age | Two-Five Years Old | 6-12 Years Old | Adults |

For face masks 10 that have 1" wide elastic headband 20; there are no adjustments needed.

For face masks 10 that have a bungee cord strap 44, the bungee cord strap 44 cord on the back of the neck or head. Once the face mask 10 is placed on the head and is positioned properly over the nose and mouth, an adult will adjust the bungee cord strap 44 so that the face mask 10 fits properly without falling. A child is able to pull the face mask 10 from the nose and mouth area to drink liquids and to eat. The face mask 10 will lie comfortably around the chest area. This position is less restricting for a child and there is not enough room for child to strangle. For a complete removal, the bungee cord strap 44 can be fully released to remove it in an upward direction above child's head.

Having described my invention, however, many modifications thereto will become apparent to those skilled in the art to which it pertains without deviation from the spirit of the invention as defined by the scope of the appended claims. Although the invention has been explained in relation to its preferred embodiment, it is to be understood that many other possible modifications and variations can be made without departing from the spirit and scope of the invention.

What is claimed is:

1. An improved face mask comprising a barrier for viral and pathogenic materials and which in its preferred embodiment operates as a covering for the nose, mouth, and areas the face of a user being adjacent thereto, said improved face mask comprising, a) a face mask having opposing side walls, top rims and capable of extending along the sides of said face of said user, b) an adjustable headband being constructed of a flexible material and being removably attached to said opposing side walls of said face mask, c) said flexible material having opposing sides, a front instructional surface, a back instructional surface, an interior space for storing items, a top portion and a bottom portion and being constructed by vertical sealing of said fabric material at said top portion and said bottom portion and whereby said top portion and said bottom portion are closed; said front instructional surface and said back instructional surface being instructional surfaces for instruction and for displaying instructional materials;

d) said top portion having a longitudinally extending internal channel for receiving a bungee cord strap having a tension and a length and wherein said longitudinally extending internal channel has a first, second, and third bungee cord opening;

e) the bungee cord strap being secured to a plurality of bungee cord adjustment mechanisms that allows for said first, said second, and said third bungee cord openings to securely engage with each other along the length of the bungee cord strap; said bungee cord adjustment mechanism being capable of adjusting both the tension and length of said bungee cord strap;

f) a plurality of elongated through holes for inserting elongated items, an internal pocket, and an external pocket having a flap with an opening and closure mechanism being provided thereon;

g) said bungee cord strap being inserted into said longitudinally extending internal channel and partially extending through each of said first, second, and third bungee cord openings of said longitudinally extending internal channel, said bungee cord strap being adjustable through said first, second, and third bungee cord openings, said bungee cord strap being connected to said opposing sides of said adjustable headband;

h) said plurality of elongated through holes including an inner tube that extends substantially along said top portion of said adjustable headband, a top opening, a bottom opening, and wherein said plurality of elongated through holes are composed of a flexible material and are disposed on said front instructional surface of said adjustable headband and wherein said plurality of elongated through holes are permanently affixed to said adjustable headband;

i) a said internal pocket being an entry point for said interior space of said adjustable headband being provided on at least one of said opposing sides of said adjustable headband, said internal pocket having an opening and closure mechanism and being disposed on the interior space of said adjustable headband, and wherein said internal pocket is permanently affixed to said adjustable headband;

j) said external pocket opening sideward and adjacent to said adjustable headband.

2. The face mask of claim 1 wherein said adjustable headband is detachable from said opposing side walls of said face mask.

3. The face mask of claim 1 wherein said adjustable headband is capable of being used as storage for said items.

4. The face mask of claim 1 wherein said adjustable headband is dimensioned to fit over the back of the head of said user.

5. The face mask of claim 1 wherein said adjustable headband is capable of extending along said head of said user.

6. The face mask of claim 1 wherein said front instructional surface and said back instructional surface of said adjustable headband are adapted to receive stickers.

7. The face mask of claim 1 wherein said front instructional surface and said back instructional surface of said adjustable headband are made of materials that allow for the placement of decorative elements.

8. The face mask of claim 1 wherein said front instructional surface and said back instructional surface of said adjustable headband are adapted to be a writeable surface.

9. The face mask of claim 1 wherein said front instructional surface and said back instructional surface of said adjustable headband are adapted to be an erasable surface.

10. The face mask of claim 1 wherein said front instructional surface and said back instructional surface of said adjustable headband are adapted to be washed and reused.

11. The face mask of claim 1 wherein said front instructional surface and said back instructional surface of said adjustable headband are adapted to be visible at nighttime or in a dark place.

12. The face mask of claim 1 wherein said plurality of elongated through holes transverse said front instructional surface of said adjustable headband.

* * * * *